US005194683A

United States Patent [19]

Tsumura et al.

[11] Patent Number: 5,194,683

[45] Date of Patent: Mar. 16, 1993

[54] KARAOKE LYRIC POSITION DISPLAY DEVICE

[75] Inventors: Mihoji Tsumura; Shinnosuke Taniguchi, both of Osaka, Japan

[73] Assignee: Ricos Co., Ltd., Japan

[21] Appl. No.: 714,279

[22] Filed: Jun. 12, 1991

[30] Foreign Application Priority Data

Jan. 1, 1991 [JP] Japan ..... 3-10019

[51] Int. Cl.[5] ..... G10H 7/00

[52] U.S. Cl. ..... 84/645; 84/602; 84/609; 84/DIG. 11; 369/70

[58] Field of Search ..... 84/600, 601, 602, 604, 84/605, 619, 645, 647, 648, 657, DIG. 11; 369/65, 70

[56] References Cited

U.S. PATENT DOCUMENTS

| | | | |
|---|---|---|---|
| 3,913,135 | 10/1975 | Damlamian . | |
| 4,159,008 | 5/1985 | Takenouchi et al. | 360/79 |
| 4,295,154 | 10/1981 | Hata et al. | 358/4 |
| 4,581,484 | 4/1986 | Bendig | 364/900 |
| 4,942,551 | 7/1990 | Klappert et al. | 84/645 X |
| 4,953,035 | 8/1990 | Yoshio . | |
| 4,992,886 | 2/1991 | Klappert | 358/342 |
| 5,038,660 | 8/1991 | Watanabe | 84/601 |
| 5,046,004 | 9/1991 | Tsumura et al. | 84/645 X |
| 5,062,097 | 10/1991 | Kumaoka | 84/645 X |
| 5,092,216 | 3/1992 | Wadhams | 84/602 |
| 5,127,303 | 7/1992 | Tsumura et al. | 84/609 |
| 5,131,311 | 7/1992 | Murakami et al. | 84/609 |

FOREIGN PATENT DOCUMENTS

| | | |
|---|---|---|
| 0427447 | 5/1991 | European Pat. Off. . |
| 1-205781 | 8/1989 | Japan . |

OTHER PUBLICATIONS

European Search Report for EP 91 11 3410.

Patent Abstracts of Japan, vol. 13, No. 508 (P-960) Nov. 15, 1989.

*Primary Examiner*—William M. Shoop, Jr.

*Assistant Examiner*—Jeffrey W. Donels

*Attorney, Agent, or Firm*—Thompson, Hine and Flory

[57] ABSTRACT

The purpose of the invention is to ensure that when digitally coded music is being reproduced as audio signals and lyrics are being displayed on a screen that the progress of the two operations is synchronized.

To this end music reproduction data is processed for reproduction in accordance with division values calculated on the basis of tempo data contained in the said music reproduction data while synchronization with the current position in the lyrics, which are displayed on a visual display unit, is advanced in accordance with values derived through multiplication of the aforementioned division values by a constant factor, thereby ensuring the synchronization of the reproduction of the music and the display of the current lyric position on the visual display unit.

3 Claims, 7 Drawing Sheets

KARAOKE LYRIC POSITION DISPLAY DEVICE

BACKGROUND OF THE INVENTION

1. Field of the Invention

This invention relates to a device for the synchronization of musical reproduction and the display of the current position in the lyrics when music expressed in terms of a digital code which conforms to the MIDI standard, for example, is reproduced on a MIDI sound source such as a synthesizer and the lyric which accompany the music are simultaneously displayed on some sort of visual display unit.

2. Description of the Prior Art

The MIDI standard is already known as a mode for the expression of music in digital code by breaking the music down into its constituent elements such as tempo, intervals, lengths of sound and timbre. Music created on the basis of this standard can also be used as a form of music sometimes known as "karaoke" music. For the performance of karaoke music it is necessary that the singer has access to the words of the song and recently it has become common practice to display the words on a display medium such as a visual display terminal for the singer to read while he is singing. The applicant has made a succession of applications in receipt of this sort of technology (for example, Patent Application S63-308503, Patent Application H1-3086, Patent Application H1-11298).

SUMMARY OF THE INVENTION

For karaoke it is necessary not only to display the lyrics on screen but also to indicate the current position in the lyrics while at the same time maintaining synchronization with the reproduction of the music. To this end it is possible to introduce a large number of markers into the composition data such that each time a marker signal is input the current position in the lyrics is indicated on the screen.

However, if the current position in the lyrics is displayed letter by letter this results in a jerky presentation. It would be better if intermediate positions in each letter could also be included but this requires the insertion of far more markers into the data stream with the result that the composition data itself becomes larger and musical reproduction processing time is slowed down.

It would be possible to avoid this problem by introducing a smoothing process into the space between each pair of markers and to display the current position more smoothly in this way. This, however, would not only result in the further complication of the program but would also necessitate such additional measures as the advancing of the position of each marker in the stream of music data with the result that the work of data creation would become that much more complex.

It is the object of this invention to speed up the processing of data by using two microprocessors, one for musical reproduction processing operations and the other for lyric display processing operations, and to introduce control data ahead of each piece of composition data and then to advance the musical performance by means of composition control signals obtained by the division of said control data while at the same time advancing the indication of the lyric position on screen smoothly and in small stages with the help of lyric control signals obtained by the multiplication of said composition control signals.

In order to achieve the above objective this invention requires the storing of composition data created in conformity with the MIDI standard, lyric data which constitutes the words of the songs and control data in a memory device. The first microprocessor must read control data from the memory device and then, by interrupt processing in respect of the composition control signals obtained by dividing the clock time in accordance with the control data, it must read composition data out of the memory device and convert said composition data to audio signals with the help of a MIDI sound source. At the same time the second microprocessor must read lyric data block by block from the memory device and, by means of interrupt processing in respect of the lyric control signals obtained by the multiplication of said composition control signals, it must produce signals for the display of the current lyric position. The invention must then display the lyrics in blocks on the visual display unit while at the same time providing an on-screen indication of the singer's position in the lyrics.

DESCRIPTION OF THE PREFERRED EMBODIMENTS

Figure 1:
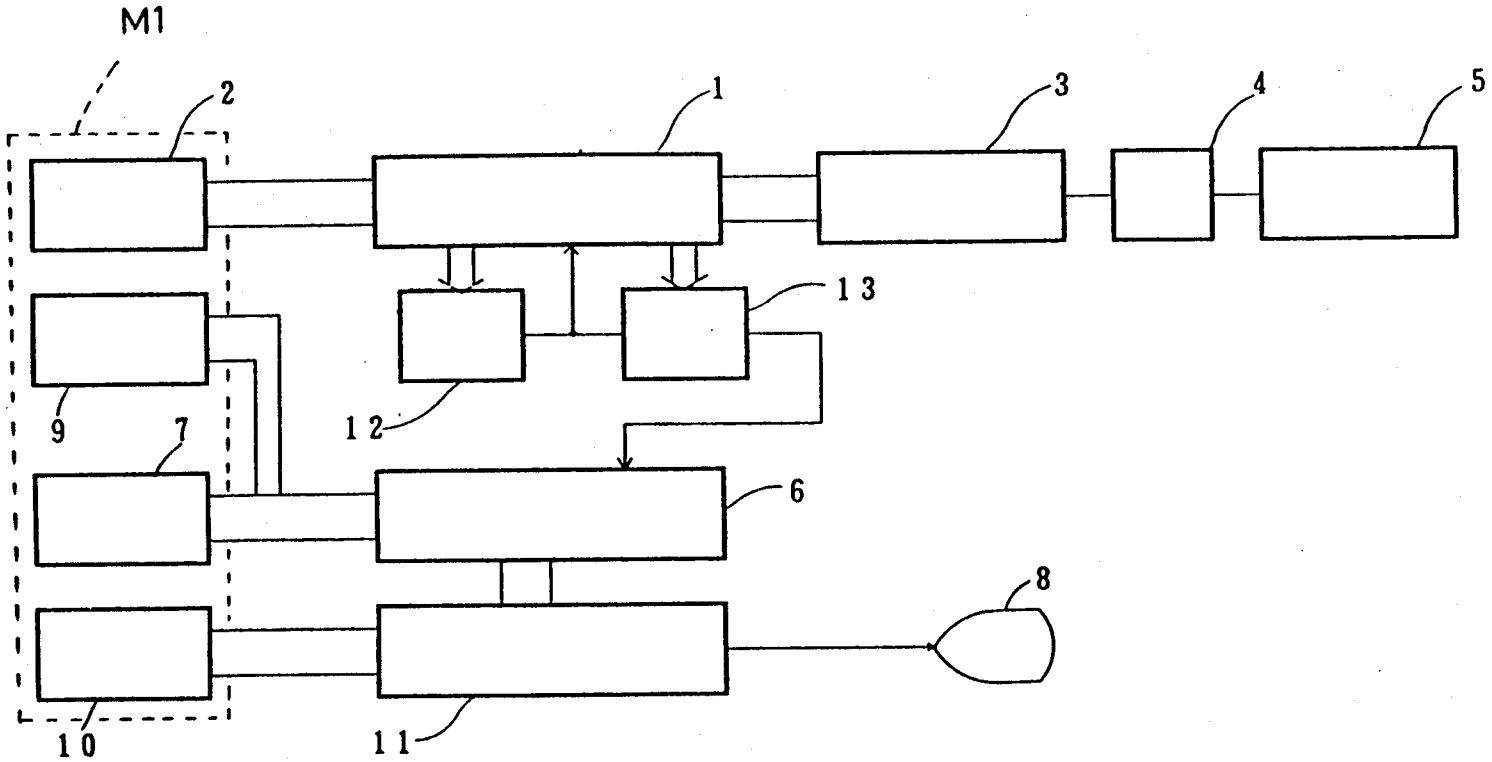
FIG.1 is a block diagram of the first preferred embodiment.

The following is a description of the first preferred embodiment by reference to FIG. 1. In the figure 1 indicates the first or dedicated music reproduction microprocessor which reads composition data from the composition data memory 2 in which is stored composition data created in conformity with the MIDI standard. The first microprocessor then outputs said composition data through the parallel/serial interface 3 to the MIDI sound source 4. The MIDI sound 4 is used to convert composition data to audio signals. The audio signals are amplified and output through a speaker in the form of music by the amplification and reproduction unit 5. Control data is written in at the head of the composition data. The control data itself is digitally coded information relating to the tempo of the music.

6 is the second or dedicated lyric display microprocessor which reads lyric data corresponding to the aforementioned composition data block by block from the lyric memory 7 which is used to store lyric data in the form of character code. The second microprocessor 6 reads coordinate data from the coordinate memory 9 which holds in the form of coordinate data the coordinates required for the display of each character of lyric data on the visual display unit 8 and carries out the processing required for the display of the lyrics in the prescribed position on the visual display unit 8. 11 is a video processor which reads video data out of the video memory 10, which stores backgrounds such as dynamic images in the form of video data, and, after combination with signals output by the second microprocessor 6, outputs the resultant data to the visual display unit 8. In the above embodiment memory device M1 is composed of a composition data memory 2, a coordinate memory 9, a lyric data memory 7 and a video memory 10.

Next the synchronization of the reproduction of the music and the on-screen indication of lyric position will be explained. 12 is a divider which divides the time of the master clock of the first microprocessor 1 in accordance with the contents of the control data in order to obtain the composition control signals, which will form the basis for the tempo at which the music is reproduced, and then inputs said composition control signals in the form of interrupt signals to the first microprocessor 1. A frequency multiplier 13 is then used to multiply the composition control signals by a constant factor in order to obtain the lyric control signals which it then inputs in the form of interrupt signals to the second microprocessor 6. The lyric control signals are used to alter the on-screen color of the lyric and the intervals between them are smaller than those between composition control signals. Change of color are thus to that extent smoother. For example, with a constant factor of say 24 for the divider 13 it is possible to effect color changes in terms of signal dot units on the visual display unit 8.

In cases where lyrics are displayed just one line at a time on the visual display unit 8, one-dimensional coordinate data in the form X1, X2 and so on will suffice. Where more than one line of lyrics is displayed at the same time, however, the coordinate data will have to be formulated in two-dimensional (X1.Y1) -- (Xn.Yn) and so on. In the latter case the X coordinate represents a number of dots while the Y coordinate is a number indicating which line is the target line. When the coordinate data in the second microprocessor 6 exceeds a predetermined value then a page feed operation is carried out. In other words, the lyrics currently displayed on the visual display unit 8 are replaced by the next block of lyrics.

Next the operation of the device illustrated in this embodiment will be described. When the reproduction of a specified piece of music is initiated, the first microprocessor 1 first reads the control data and then calculates the division value and transfers it to the divider which uses said division value to divide the master clock signal and thereby obtain the required composition control signals. The said composition control signals are then input as interrupt signals to the first microprocessor 1. This same interrupt processing is then used to output the composition data in sequence to the parallel/serial interface 3 and it is then converted by the MIDI sound source 4 to audio data. The reproduction of the music is in this way advanced at a tempo which corresponds to the division values. At the same time as or else just before the initiation of the reproduction of the music, the second microprocessor 6 reads one block of lyric data out of the lyric data memory 7 and displays it on the visual display unit 8 at the position specified by the coordinate data. Next the music composition control signals obtained from the divider 12 are multiplied by a constant factor in the frequency multiplier 13 in order to obtain the lyric control signals which are then input as interrupt signals to the second microprocessor 6. This interrupt processing thus enables the changing of the color of the lyrics in accordance with the pointer units of the coordinate data. The indication of the lyric position is in this way advanced in smoothly in small stages. As explained above, the smaller the intervals between the interrupt signals the smoother the on-screen color change. The page feed operations are carried out in accordance with the advance of the coordinate data and the color change operation accordingly also continues until the end of the piece of music being reproduced.

Figure 2:
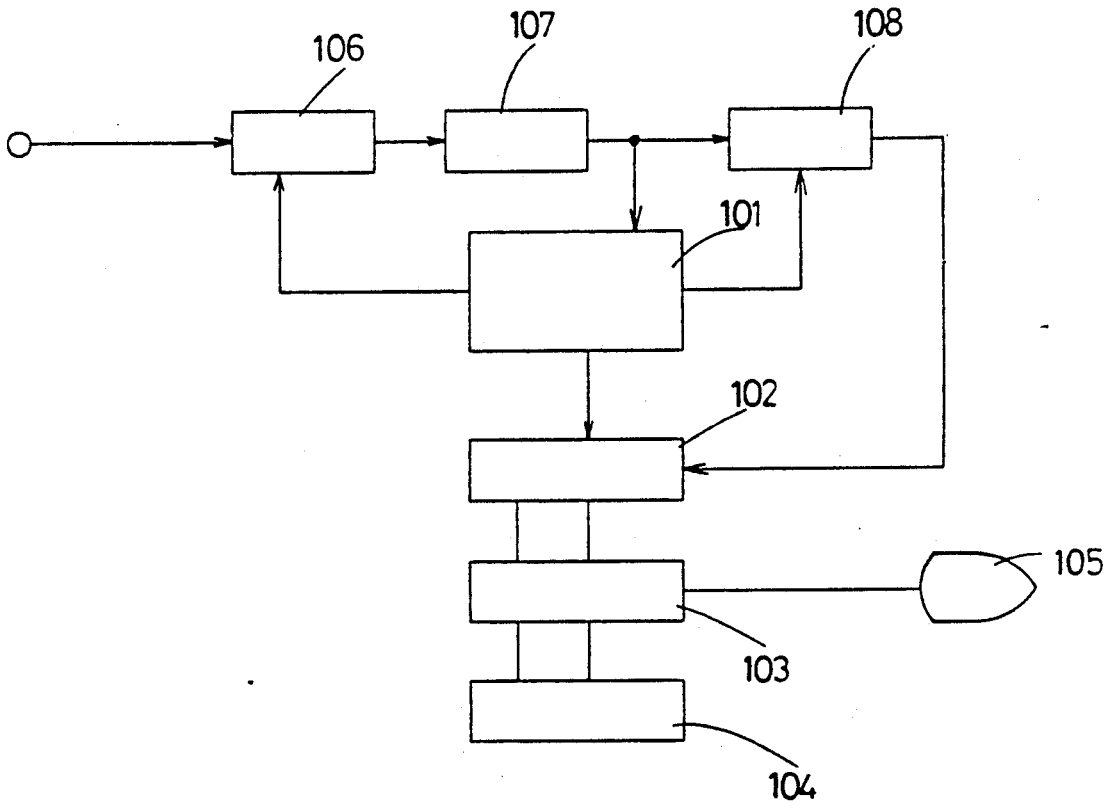
FIG. 2 is a block diagram of the second preferred embodiment.
Figure 3:
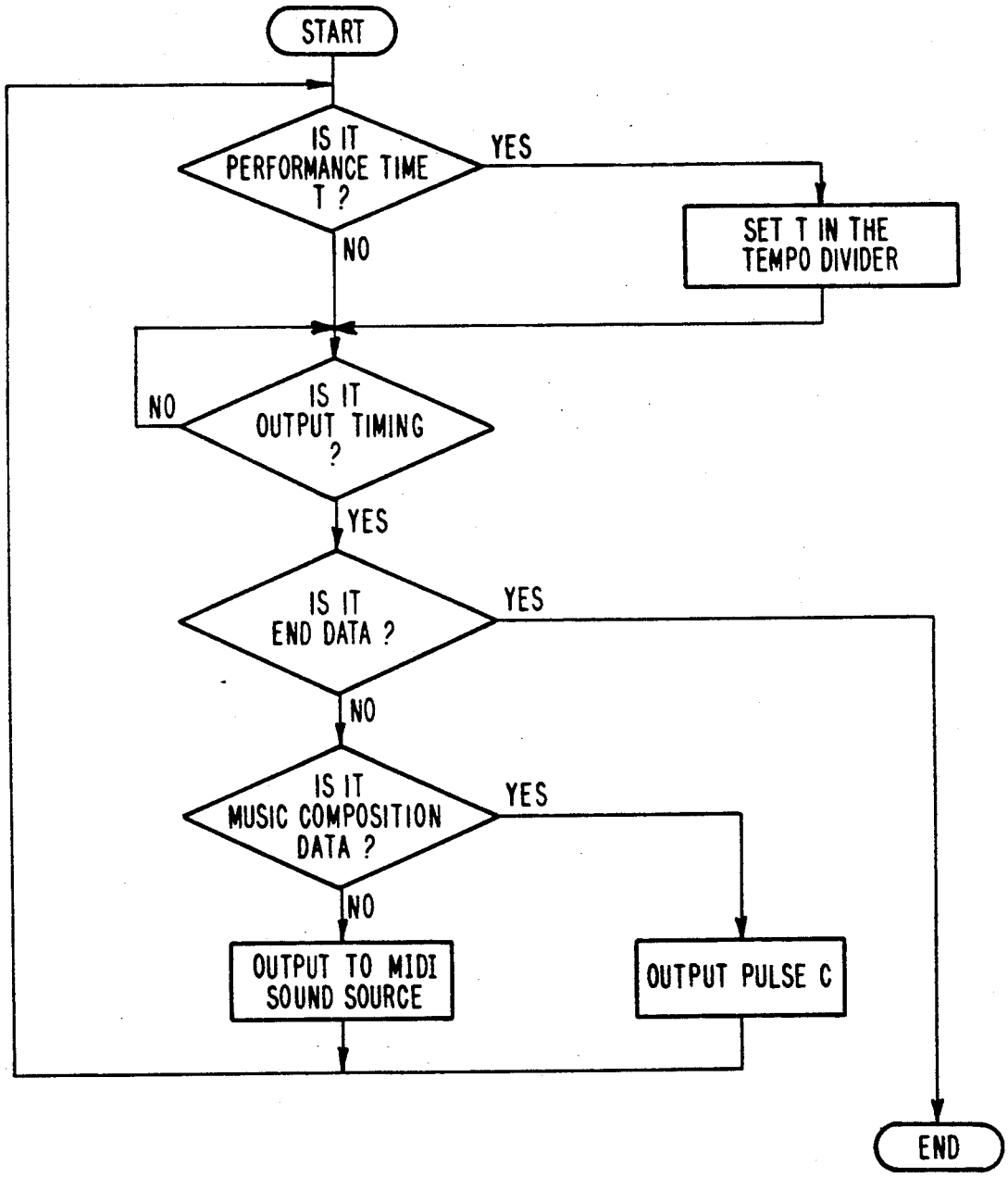
FIG. 3 and FIG. 4 are flowcharts of the second preferred embodiment.
Figure 4:
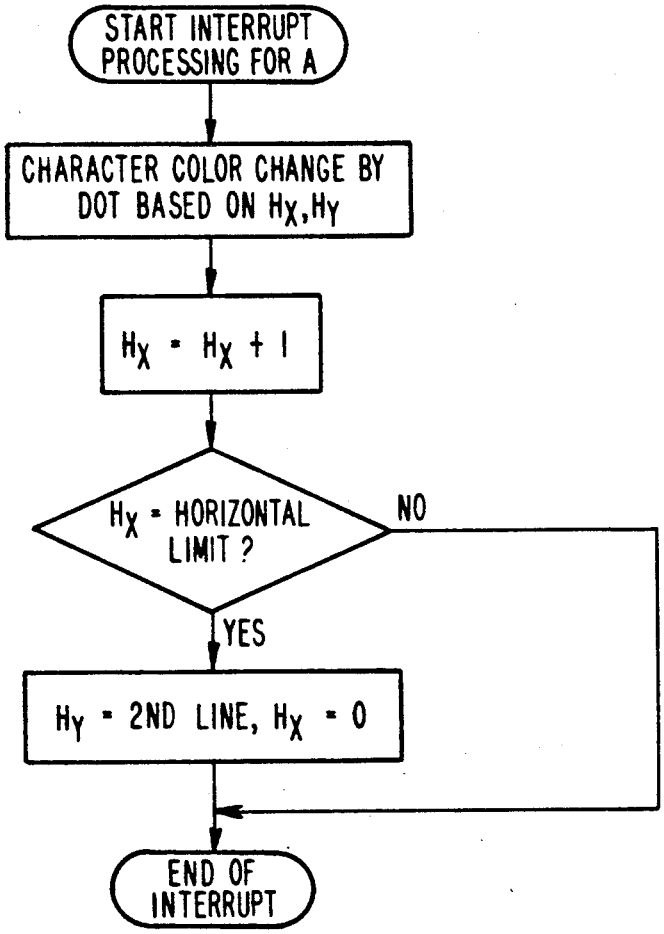

The second preferred embodiment will now be described by reference to FIGS. 2 to 4. In FIG. 2 101 is the first microprocessor which reads composition data out of the memory device (not shown in the figure) and outputs it to the MIDI sound source (not shown in the figure) while at the same time reading lyric data and control data from the memory device and outputting it to the second microprocessor 102. In other words, the first microprocessor 101 has a higher processing speed than the second microprocessor 102 and is thus assigned the function of the main microprocessor. The second microprocessor 102 has connections to the video processor 103 and the video RAM 104. Lyric data saved temporarily to the video RAM 104 from the second microprocessor 102 is transmitted by way of the video processor 103 for display on the visual display unit 105.

This embodiment requires the use of two dividers 106, 107 and one frequency multiplier 108. The control data consists of music tempo data, the number of horizontal resolution dots of a single lyric character and the performance time of a single lyric character. If, for example, a character consists of 24 horizontal dots and 36 vertical dots, then the number of horizontal resolution dots will be 24. In the case of a vertically written lyric display the number of horizontal resolution dots would be replaced by the number of vertical resolution dots, in this case 36. First the first divider 106 divides the internal clock signal of the first microprocessor 101 in accordance with the music tempo data. The resultant signal is then divided in the second divider 107 by the number of horizontal resolution dots in order to obtain the required composition control signals which are then input as interrupt signals to the first microprocessor 101. In this way the reproduction of the piece of music is advanced at a tempo which corresponds to the division values. The frequency multiplier 108 is then used to multiply the composition control signals by the performance time for a single lyric character in order to obtain the lyric control signals which are then input as interrupt signals to the second microprocessor 102. The on-screen color of each character is changed in this way and, since multiplication has been carried out in accordance with the performance time for a single lyric character, the indication of current lyric position is therefore advanced smoothly and in small stages. The reason why two dividers 106, 107 have been set up independently of the first microprocessor 101 rather than providing said microprocessor 101 with a divider function is that if the first microprocessor 101 is called upon to carry out division processing at the same time as music reproduction then the time management load will automatically be increased by a corresponding amount. When moving to the next page a page feed signal is output from the first microprocessor 101 to the second microprocessor 102 and the next two lines of lyrics are displayed on the visual display unit 105.

The processing functions of the first microprocessor 101 will now be described by reference to FIG. 3. First, since the music tempo data is set from the start of musical reproduction, data up to and including the composition control signals is already determined. Thus, after identifying those pieces of data received that relate to performance time, the microprocessor sets the performance time for a single character in the frequency multiplier 108. Then, after calculating the timing of the color change for that character, it initiates the color change operation. The first microprocessor 101 repeats this series of operations until the end code is input. If, on the other hand, the data received is music data then it is output to the MIDI sound source and if it is a signal to move on to the next character then it is output to the second microprocessor 102.

The processing functions of the second microprocessor 102 will now be described by reference to FIG. 4. First, if we assume that the coordinates which are required in order to indicate the current lyric position on the visual display unit 105 are Hx, Hy, then when an interrupt pulse is input to the second microprocessor 102 in accordance with the output from the frequency multiplier 108, the single dot indicated by the coordinates Hx, Hy is subjected to a character color change operation. This same operation is then carried out on the next dot in line horizontally. When a whole line of lyrics has been subjected to a change of color in this way then the same color change process is initiated for the next line of lyrics. In this case the Hx coordinate is reset back to 0.

Figure 5:
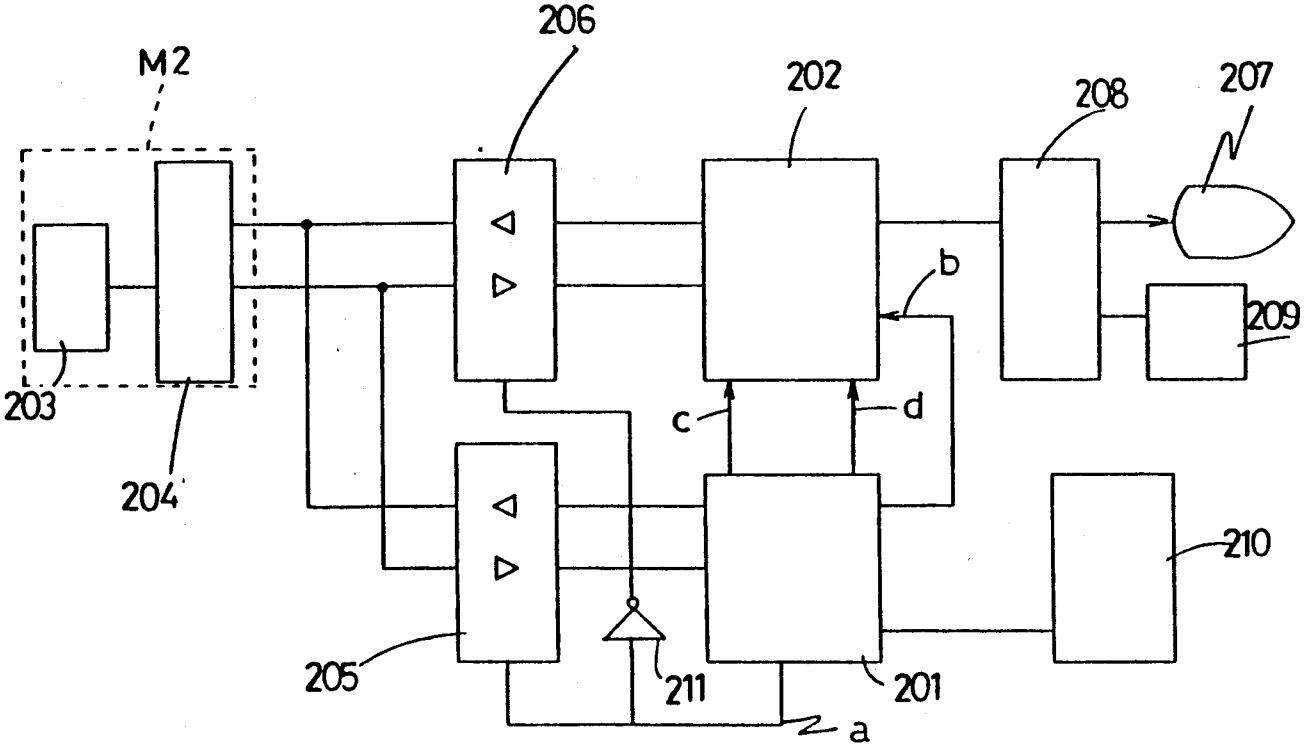
FIG. 5 is a block diagram of the third preferred embodiment.
Figure 6:
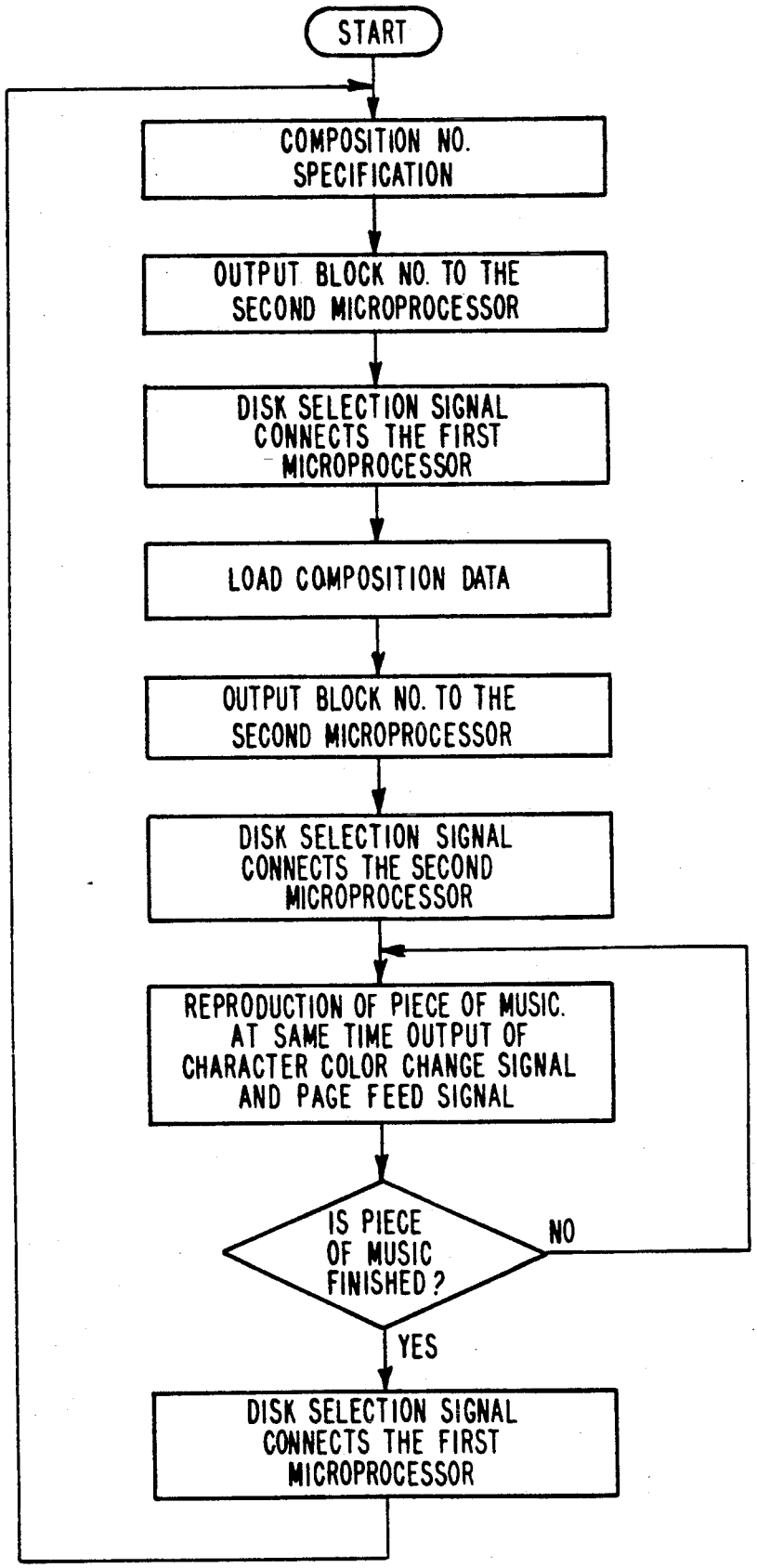
FIG. 6 and FIG. 7 are flowcharts of the third preferred embodiment.
Figure 7:
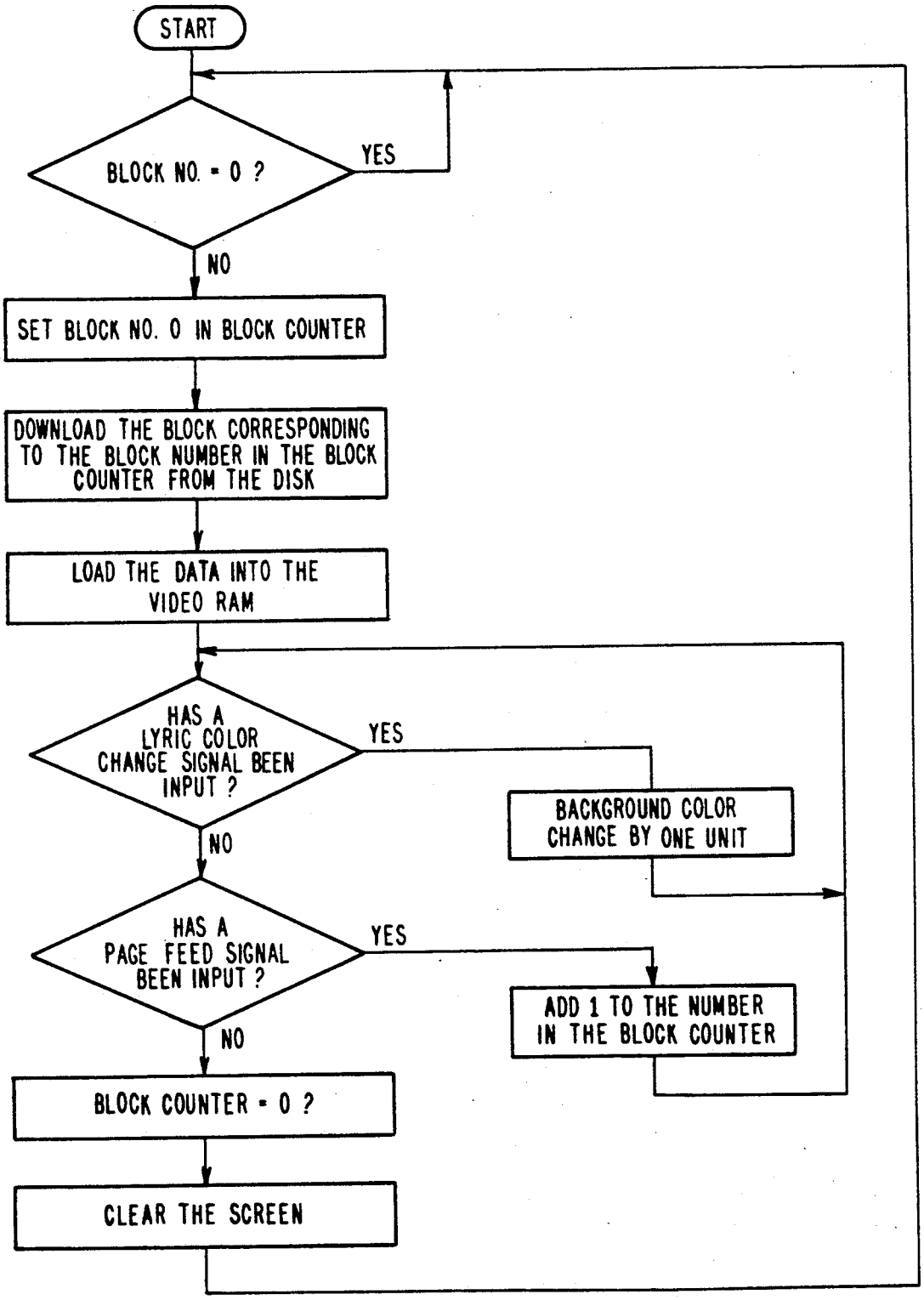

The third preferred embodiment will now be described by reference to FIGS. 5 to 7. In FIG. 5 201 is the first microprocessor and 202 is the second microprocessor. 203 is an optical memory device or, in other words, an MO disk based storage medium holding composition data, lyric data and control data. The lyric data is formulated in terms of graphics code. In this preferred embodiment the first microprocessor 201 outputs a selection signal to activate the selector switches 205, 206 which then connect either the first microprocessor 201 or the second microprocessor 202 with the storage medium 203. In other words, the selector switches 205 and 206 are each located in between the disk control device 204 and the microprocessors 201 and 202 respectively such that the setting of the disk selection signal a to either high or low will have the effect of either opening or closing the circuit at selector switch 205 while at the same time ensuring that the reverse operation is carried out at selector switch 206 through the action of an inverter 211. In this way data read out of storage medium 203 can be processed by one or other of the microprocessors 201 or 202 depending on whether it is lyric data or composition data. The aforementioned storage medium 203 and the disk control device 204 together make up the memory device M2.

The following is a description of the operation of this preferred embodiment. When a piece of music is selected using the keyboard (not shown in the figure), the first microprocessor 201 activates the disk control device 204 and loads composition and lyric data from the memory device M2 into the first microprocessor 201 by way of the selector switch 205. When this loading operation has been completed it is then necessary to load the lyric data into the second microprocessor 202. To this end a disk selection signal is fed back to selector switch 205, at the same time selector switch 206 is selected and the lyric data is loaded into the second microprocessor 202. In this case the first microprocessor 201 needs to indicate to the second microprocessor 202 which part of the storage medium 203 is holding the lyric data. For this purpose the first microprocessor 201 and the second microprocessor 202 are connected by a parallel N bit bus through which the relevant data is transferred in the form of block numbers. Furthermore, since the lyric data for a particular piece of music is necessarily stored in a number of separate blocks in the storage medium 203, considerations of read out speed and the disk management of the second microprocessor 202 have led to the storing of the lyric data in consecutive blocks. Block No. 0 has been assigned as the final code of a piece of music which means that when the second microprocessor 202 receives a block No. 0 indication from the first microprocessor 201, it immediately clears the screen of the visual display unit 207 and then waits in stand-by mode for the next lyric display. At this point the aforementioned N bit number will be the same as the microprocessor bit number. Lyric data loaded in this way is transferred by way of a graphics control device 208 for storage in the video RAM 209 and is subsequently displayed on the screen of the visual display unit 207 under the control of the second microprocessor 202. 210 is the MIDI sound source.

There now follows a description of the display of lyrics on screen and the change of lyric color. These processing operations are carried out by means of page feed signal c and lyric color change signal d which are transmitted in the form of interrupt signals from the first microprocessor 201 to the second microprocessor 202. The page feed signal c is, in fact, already inserted in the composition data. For example, if there are say two lines of lyrics to be displayed on the visual display unit 207, which means that the lyrics will thus have to be changed every two lines, then signals are inserted into the composition data at all appropriate points. In the case of the lyric color change signal d, the color of the lyrics is changed gradually in dot sized units each time the signal is output. The more signals that are output, therefore, the smoother and more natural the lyric color transition will be.

The processing operations of the first microprocessor 201 will now be described by reference to FIG. 6. First the keyboard is used to select the required piece of music, then the first microprocessor output block No. 0 to the second microprocessor 202 and clears the screen of the visual display unit 207. Disk selection signal a then activates selector switch 205 such that the first microprocessor 201 is connected to the storage medium 203 and the composition data is loaded into the first microprocessor 201. Next the block numbers of the required lyric data are output to the second microprocessor 202, disk selection signal a is altered in such a way as to open selector switch 206. Control of the storage medium 203 is then passed to the second microprocessor 202 to enable the loading of the required lyric data. The piece of music is now reproduced and the first microprocessor 201 continues to output the page feed signals a and the lyric color change signals d, which have been inserted into the composition data, to the second microprocessor 202 until the data has been exhausted At this point disk selection signal a returns control of the storage medium 203 to the first microprocessor 201 which then enters stand-by mode to await the specification of the next piece of music.

Next the processing operations of the second microprocessor 202 will be described by reference to FIG. 7. When block No. 0 is input from the first microprocessor 201, the second microprocessor 202 clears the screen of the visual display unit 207 and then waits for the input of the next natural block number. When the next block number is input it is first set in the block counter and the disk control device 204 activated in order to download the corresponding block from the storage medium 203 to the video RAM 209. The lyric is at the same time displayed on the visual display unit 207. The second microprocessor also changes the lyric display every two lines, for example, and gradually alters the color of the lyrics in response to the input of lyric color change signals d and page feed signal c. When block No. 0 is finally input the second microprocessor 202 clears the display screen and then awaits the specification of the next piece of music.

In all the preferred embodiments described above the adoption of either a one-dimensional lyric display (1 line display) or a two dimensional lyric display (2 line display) makes no difference to the basic processing operations. Moreover, the display of the current lyric position can be effected either by color change or else with the help of an arrow or by underlining as preferred.

What is claimed is:

1. A karaoke lyric position display device of the type displaying lyrics in synchronization with the reproduction of music associated with the lyrics in response to composition data representing the music in MIDI format, control data representing tempo, blocks of lyric data and coordinate data indicating a display position of the lyric data and having predetermined values representing a page of lyric data, the karaoke lyric position display device comparing:

memory means for storing the composition data, the lyric data, the coordinate data and the control data;

first microprocessor means having a clock signal and connected to the memory means for reading the composition data from said memory means, said first microprocessor means including frequency divider means responsive to the clock signal and the control data for producing composition control signals, said first microprocessor means responding to the composition controls signals as interrupt signals for producing an output of the composition data as a function of the tempo;

MIDI sound source means responsive to the output of composition data by the first microprocessor means for converting the composition data into audio signals;

second microprocessor means connected to the memory means for reading the blocks of lyric data and the coordinate data, said second microprocessor means including frequency multiplier means responsive to the composition control signals for providing lyric control signals, said second microprocessor means responding to the lyric control signals as interrupt signals for generating outputs signals representing a current lyric position within a block of lyric data and said second microprocessor means executing a page feed of lyric data in response to the coordinate data exceeding the predetermined values; and visual display means connected to the second microprocessor means for simultaneously displaying the blocks of lyric data and the current lyric position within a block of lyric data.

2. The device according to claim 1 in which the first microprocessor means reads lyric data from the memory means and in which the second microprocessor means reads lyric data from the first microprocessor means.

3. A karaoke lyric position display device of the type displaying lyrics in synchronization with the reproduction of music associated with the lyrics in response to composition data representing the music in MIDI format, blocks of lyric data and control data including tempo data, a number of horizontal resolution dots for a single lyric character and a performance time of a single lyric character, the karaoke lyric position display device comprising:

memory means for storing the composition data, the lyric data and the control data;

first microprocessor means having a clock signal and connected to the memory means for reading the composition data from said memory means, said first microprocessor means including frequency divider means responsive to the clock signal and the control data for producing composition control signals by dividing the clock signal in accordance with the music tempo data and then by the number of horizontal resolution dots, said first microprocessor means responding to the composition controls signals as interrupt signals for producing an output of the composition data as a function of the tempo;

MIDI sound source means responsive to the output of composition data by the first microprocessor means for converting the composition data into audio signals;

second microprocessor means connected to the memory means for reading the blocks of lyric data, said second microprocessor means including frequency multiplier means responsive to the composition control signals for providing lyric control signals by multiplying the performance time by the composition control signals, said second microprocessor means responding to the lyric control signals as interrupt signals for generating output signals representing a current lyric position within a block of lyric data; and visual display means connected to the second microprocessor means for simultaneously displaying the blocks of lyric data and the current lyric position within a block of lyric data.

* * * * *

UNITED STATES PATENT AND TRADEMARK OFFICE

CERTIFICATE OF CORRECTION

PATENT NO. :5,194,683
DATED :March 16, 1993
INVENTOR(S) :M. Tsumura, et. al.

It is certified that error appears in the above-indentified patent and that said Letters Patent is hereby corrected as shown below:

Claim 1, Column 7, line 25, delete "comparing" and insert --comprising--.
line 51, delete "outputs" and insert --output--.

Signed and Sealed this

Fifteenth Day of March, 1994

*Attest:*

Bruce Lehman

BRUCE LEHMAN

*Attesting Officer*

*Commissioner of Patents and Trademarks*